United States Patent [19]

Vallak et al.

[11] Patent Number: 4,515,341

[45] Date of Patent: May 7, 1985

[54] INGOT MOULD HAVING A HOT-TOP INSIDE THE UPPER PART OF THE MOULD

[75] Inventors: Enn Vallak; Hannes Vallak, both of Geneva, Switzerland

[73] Assignee: International Ferrox Co., Establishment, Vaduz, Liechtenstein

[21] Appl. No.: 513,743

[22] Filed: Jul. 14, 1983

Related U.S. Application Data

[62] Division of Ser. No. 285,112, filed as PCT EP80/00131, Nov. 11, 1980, published as WO81/01377, May 28, 1981, §102(e) date Jul. 10, 1981, abandoned.

[30] Foreign Application Priority Data

Nov. 13, 1979 [GB] United Kingdom ..... 7939186
Mar. 13, 1980 [GB] United Kingdom ..... 8008629

[51] Int. Cl.[3] ..... B22D 7/10

[52] U.S. Cl. ..... 249/106; 249/197; 249/199; 249/200

[58] Field of Search ..... 249/106, 197, 199, 200, 249/DIG. 5

[56] References Cited

U.S. PATENT DOCUMENTS

| | | | |
|---|---|---|---|
| 1,399,798 | 12/1921 | Rowe | 249/106 X |
| 1,523,210 | 1/1925 | Howard et al. | 249/106 |
| 1,738,600 | 12/1929 | Messler et al. | 249/199 |

FOREIGN PATENT DOCUMENTS

| | | |
|---|---|---|
| 577693 | 5/1933 | Fed. Rep. of Germany . |
| 2061743 | 7/1971 | Fed. Rep. of Germany . |
| 1396810 | 4/1965 | France . |
| 100549 | 6/1916 | United Kingdom . |
| 689465 | 3/1953 | United Kingdom . |
| 722536 | 1/1955 | United Kingdom . |
| 731324 | 6/1955 | United Kingdom . |
| 1025184 | 4/1966 | United Kingdom . |

OTHER PUBLICATIONS

PCT Gazette WO79/00596, published Aug. 23, 1979.

*Primary Examiner*—Nicholas P. Godici
*Assistant Examiner*—J. Reed Batten, Jr.
*Attorney, Agent, or Firm*—Shlesinger Arkwright Garvey & Fado

[57] ABSTRACT

The ingot mould comprises a hot-top positioned inside the upper part of the mould and comprising an inner wall formed by at least one plate of a material capable of withstanding contact with a molten metal poured into the ingot mould, without being melted or fused. The thickness of the inner wall is less than that of the wall of the mould, at least one recess is provided inside the upper part of the mould wall and the inner wall of the hot-top is placed in the recess, with its surface essentially flush and aligned with the inner surface of the mould, so as to form a closure wall separating the interior of the recess from the interior of the mould.

18 Claims, 18 Drawing Figures

INGOT MOULD HAVING A HOT-TOP INSIDE THE UPPER PART OF THE MOULD

This is a division of application Ser. No. 285,112 filed as PCT EP80/00131, Nov. 11, 1980, published as WO 81/01377, May 28, 1981, § 102(e) date July 10, 1981 and now abandoned.

The present invention concerns an ingot mould comprising a hot-top positioned inside the upper part of the mould, said hot-top comprising an inner wall formed by at least one plate of a material capable of withstanding contact with a molten metal poured into the ingot mould, without being melted or fused, the thickness of said inner wall being less than that of the wall of the mould, at least one recess being provided inside the upper part of the mould wall and the inner wall of the hot-top being placed in said recess with its surface essentially flush and aligned with the inner surface of the mould, so as to form a closure wall separating the interior of said recess from the interior of the mould.

The invention further concerns a process for manufacturing an ingot mould comprising a hot-top positioned inside the upper part of the mould, said hot-top comprising an inner wall formed by at least one plate of a material having a thermal expansion greater than that of the wall of the mould, the thickness of said inner wall being less than that of the wall of the mould, said plate being attached to the wall of the mould by securing members.

Such an ingot mould is described in international patent application No. PCT/EP79/00003 published under international publication No. WO 79/00596 on Aug. 23, 1979.

The use of hot-tops positioned at the upper end of an ingot mould, either on the mould or inside the mould, to prevent the upper portion of the ingot from cooling too rapidly with respect to the remainder of the ingot, thus limiting pipe-formation in the ingot, is well known in the casting of metals, particularly iron and steel.

The ingot mould of the type which is described in the above-indicated international application has the great advantage over the previously known ingot moulds provided with hot-tops that, owing to the thermal expansion of the inner wall of the hot-top which occurs during casting a metal in the mould, after formation of an outer shell of solidified metal, the inner wall of the hot-top is moved off of the ingot without any external manipulation of the hot-top, so that a gap is formed between said inner wall and the ingot, this gap acting as a very efficient thermal insulation thus enhancing efficiency of the hot-top in limiting pipe-formation. Furthermore, since, owing to said gap formation, contact between the inner wall of the hot-top and the ingot is avoided during a preponderant part of the duration of the ingot solidification. Also, contamination of the ingot is considerably reduced and is often lowered to a negligible amount.

An object of the present invention is to provide an improved form of the ingot mould described in international application No. PCT/EP 79/00003, the improvement being particularly related to the simplicity and ease of construction of the hot-top, thus enabling to keep the costs at a very low level, and also to the ease of manipulation of the hot-top, in particular for the purpose of maintenance and repair, thus also allowing a significant reduction of corresponding costs to be achieved.

A further object of the present invention is to provide a process for manufacturing such an ingot mould in a simple and economical way, thus allowing mass production of such moulds at low cost.

According to one aspect of the invention, a plurality of recesses are provided inside the upper part of the mould, said recesses extending over the flat parts or parts of great radius of curvature of the inner wall of the mould and being separated from each other by the edge parts or parts of small radius of curvature of the inner wall of the mould, and the inner wall of the hot-top being formed by separate plates each of which is placed in one of said recesses, with its inner surface being essentially flush and aligned with the corresponding part of the inner surface of the mould, said plates being laterally maintained in contact with the parts of the mould separating the recesses from each other, the outer surface of each plate being spaced from the confronting surface of the corresponding recess and the thus formed space being at least partially filled with a heat insulating material capable of being deformed under compression.

According to a second aspect of the invention, the mould is made by casting while securing members are partially embedded in the wall of the mould during the casting step.

The mould may comprise, further to the outer wall thereof and to the hot-top, a protecting collar applied on the top of the mould and held in place by securing members. In this case, the collar securing members may also be partially embedded in the wall of the mould during the casting step.

In order that the present invention may be more readily understood, various embodiments thereof will be described by way of example and with reference to the accompanying drawings, in which.

Figure 1:
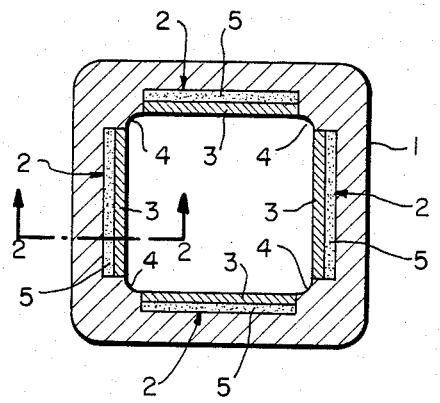
FIG. 1 is a plan view of an ingot mould according to the invention.

The ingot mould 1 which is illustrated in FIG. 1 has a square section. Recesses 2 of rectangular shape are provided inside the mould and extend over the upper part of each four flat inner surfaces thereof. A metal plate 3 is placed in each recess 2, with its inner surface flush and aligned with the corresponding inner surface of the mould. The lateral edges of plate 3 are parallel and in close contact throughout their length with the lateral faces of the recess 2 in which each plate 3 is placed. Thus, in the upper part of the mould, the flat parts of the inner surface of the mould are replaced by the inner-surface of the metal plates 3, while the edge parts 4 of small radius of curvature of the inner surface of the mould separate the adjacent inner surface of the plates 3 from each other.

The spaces 5 which are left between the wall surfaces of the plates 3 opposite to the inner surfaces thereof (i.e. facing the interior of the mould) and the confronting wall surfaces of the recesses 2 are filled with a heat insulating material. Preferably, this insulating material is a compressible one, such as ceramic or fibres. However, it is to be noted that the spaces 5 do not need to be entirely filled with the heat insulating material and that, in this case, non compressible heat insulating material, such as fire bricks, may be used, while leaving an empty space between the heat insulating material and the plate 3.

Figure 2:
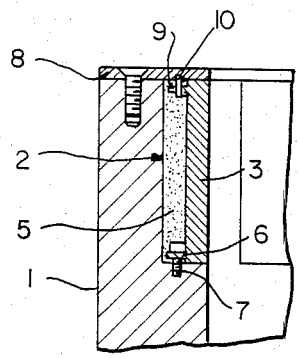
FIG. 2 shows a section of the mould along line II—II in FIG. 1.

As shown in FIG. 2, the plates 3 are secured in their location by means of ears 6, provided at the lower part of their wall surface facing the recesses 2 and of bolts 7 screwed into the bottom of the recesses 2.

In order to protect the interior of spaces 5 against projection of molten metal during teeming, a collar made of four metallic plates 8 is applied on the top of the mould and is secured in place by means of bolts. The plates 3 are further secured to the plates 8 by means of ears 9, which are attached to the upper part of plates 3, and pins 10 which are fixed under the plates 8.

The hot-top assembly provided at the upper part of the ingot mould 1 is thus of a very simple construction and is easily and rapidly dismountable. This permits quick replacement of the plates 3 for the purpose of maintenance and repair. It is to be noted that, since the plates 3 have a very simple shape, they are quite cheap to manufacture and that, since these plates can be replaced separately, the over-all cost of the hot-top assembly is much reduced in comparison with that of the other types of hot-tops.

The mould 1 may be made of any suitable metal, depending on the molten metal being cast. For instance, when the molten metal is steel, the mould 1 may be made of cast iron or of spheroidal graphite iron. The plates 3 may be made of any suitable metal having a melting point which is not more than 300° C. below the casting temperature of the molten metal. For instance, the plates 3 may be made of steel. The thickness of the plates 3 is preferably from 10 to 30 mm.

Figure 3:
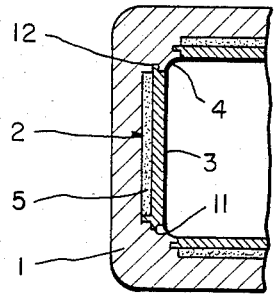
FIG. 3 is a partial plan view of another embodiment of the ingot mould according to the invention.

In the embodiment illustrated in FIG. 3, the lateral edges of plates 3 are provided with projective part 11 which are slidably inserted in corresponding grooves 12 located in the lateral walls of the recesses 2, thus enabling the plates 3 to be easily moved into and out of their location in the recesses 2 while securing them in place firmly and precisely.

Figure 4:
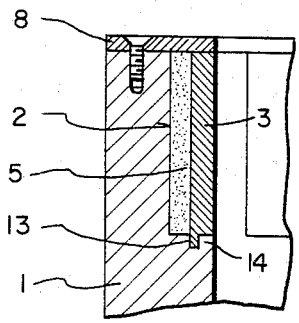
FIG. 4, shows a section of the mould, similar to FIG. 2, according to a further embodiment of the ingot mould.

In the embodiment illustrated in FIG. 4, a projective part 13 is provided under the bottom edge of plate 3 and a corresponding groove 14 is located in the bottom of the recess 2. It will be clear that the embodiments illustrated in FIG. 3 and FIG. 4 may advantageously be combined together in order to permit an optimal securing of plates 3 in their location in the recesses 2 to be achieved.

Figure 5:
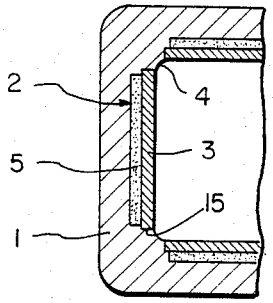
FIG. 5 is a partial plan view of another embodiment of the ingot mould.

In the embodiment illustrated in FIG. 5, the lateral edges of plate 3 have a substantially semi-circular cross-section and they cooperate with correspondingly shaped grooves 15 located in the lateral walls of recess 2.

Figure 6:
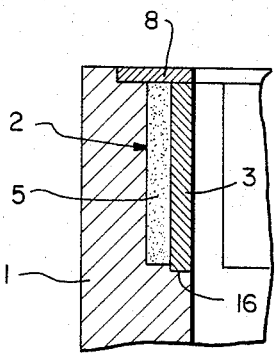
FIG. 6 illustrates a section of the mould according to another embodiment of the ingot mould.

In the embodiment illustrated in FIG. 6, the bottom edge of plate 3 has a semi-circular cross-section and cooperates with a corresponding groove 16 located in the bottom of the recesses 2. This embodiment may also be advantageously combined with the embodiment of FIG. 5.

Figure 7:
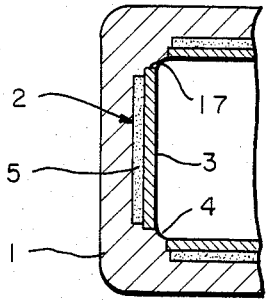
FIG. 7 is a partial plan view of another embodiment of the ingot mould.

In the embodiment illustrated in FIG. 7, the lateral edges 17 of plate 3 are slightly inclined towards the inner wall thereof and cooperate with a correspondingly inclined part of the lateral faces of recess 2.

Figure 8:
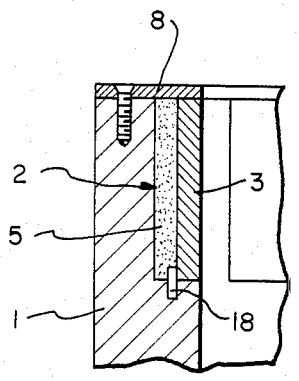
FIG. 8 shows a section of the mould according to another embodiment of the ingot mould.

In the embodiment illustrated in FIG. 8, the plates 3 are secured in their location in recesses 2 by means of pins 18 which are partly introduced into holes located in the horizontal bottom surface of the recesses 2.

Figure 9:
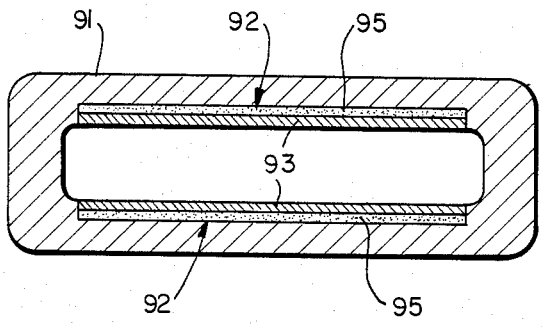
FIG. 9 is a plan view of another embodiment of the ingot mould.

The ingot mould 91 which is illustrated in FIG. 9 has a rectangular section. Recesses 92 of rectangular shape are provided inside the mould and extend over the upper part of the two lateral walls thereof which are parallel to the length of the rectangular section of the mould. A metal plate 93, similar to plates 3 of the embodiments illustrated in FIGS. 1–8, is placed in each recess 92 with its inner surface flush and aligned with the corresponding inner surface of the mould. Plates 93 are held in place in the corresponding recesses 92 in a manner similar to that of the embodiment of FIGS. 1 and 2.

A protective collar (not shown) similar to that which is used in the case of the embodiments of FIGS. 1–8, can also be applied on the top of the mould 91.

A heat insulating barrier is also provided, in the spaces 95 which are left between the plates 93 and the confronting wall surfaces of the recesses 92, the features and function of this barrier being also the same as in the case of the embodiments of FIGS. 1–8.

The ingot mould which has been described above can be used in the same manner as the mould which is described in international patent application No. PCT/EP 79/00003.

As in the case of the hot-top which is provided at the upper part of the mould described in said international patent application, the heat absorbed by the plates 3 or 93 upon teeming of the molten metal causes thermal expansion of these plates, while a thin shell of solidified metal is formed on the poured metal, said expansion being substantially more rapid than that of the mould walls.

Owing to the fact that the lateral edges of the plates 3 or 93 lean against the thick parts of the wall of the mould 1 or 91, the thermal expansion of the plates 3 or 93 result in a bending of these plates towards the spaces 5 or 95 provided in the recesses 2 or 92, and a gap is thus formed between the walls of plates 3 or 93 and the ingot shell. The width of this gap is maximum at the middle part of the plates 3 or 93, i.e. at the middle of the lateral walls of the hot-top, and practically no gap is formed near the corner of the section of the hot-top. However, the same advantages as in the case of the use of the hot-top described in international application No. PCT/EP 79/00003 are also obtained using the ingot mould according to the present invention.

Figure 10:
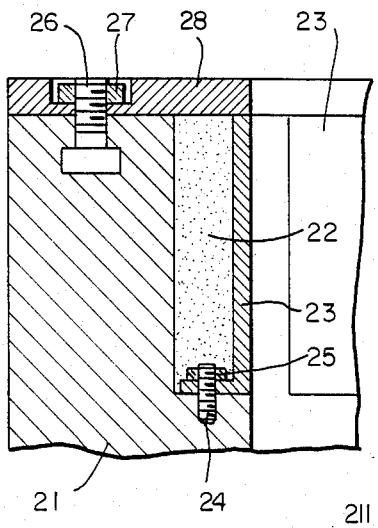
FIG. 10 shows a section of a portion of the upper part of an ingot mould, comprising a protecting collar applied on the top of the mould, according to another embodiment of the ingot mould.

The ingot mould which is illustrated in FIG. 10 comprises an outer wall 21, which is made by casting according to any suitable conventional way, and an inner wall formed by plates 23 which are attached to the wall 21 by means of threaded rods 24 and nuts 25 (only one rod 24 and one nut 25 being seen in the drawing). Each plate 23 is placed in a recess 22, provided inside the wall 21, the inner surface of plate 23 being flush and aligned with the inner surface of the mould.

Preferably, the mould wall 21 is made of cast iron and the plates 23 are made of steel. It is to be noted that the plates 23 may also be made of any suitable non-metallic material such as graphite.

The recesses 22 are filled with a heat insulating high temperature resistant material, which is preferably but not necessarily a compressible one such as ceramic fibres.

A collar made of a plate 28, which may consist of one single portion or of a plurality of separate portions, is applied on the top of the mould and is secured in place by means of bolts 26, having their head embedded in the mould wall 21 and a part of their threaded portion protruding from wall 21, and of nuts 27 (only one bolt 26 and one nut 27 being seen in the drawing).

According to the process of the invention, the threaded rods 24 and the bolts 26 are placed in appropriate position, before casting the mould wall 21, so that they are partially embedded in the wall 21, as shown in FIG. 10, during the casting step.

Thus, the manufacture of the ingot mould will require only a casting operation, to form the outer mould wall 21 and simultaneously to embed the securing members for the inner wall 23 and the cover plate 28, said casting operation being carried out according to any suitable conventional manner. Consequently, further steps, such as drilling threaded holes into the mould wall 21 in order to allow securing members for the plates 23 and/or the cover plate 28 to be attached to the mould, become unnecessary and an important simplification of the manufacturing process is achieved. Furthermore, owing to the fact that the eliminated steps are the most expensive ones, the overall cost of the manufacture of the ingot mould is considerably reduced.

Figure 11:
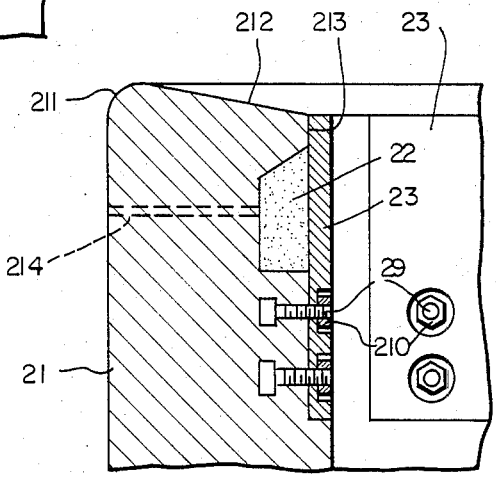
FIG. 11 shows a section of a portion of an ingot mould, without a separate protecting collar, according to another embodiment of the ingot mould.

In the ingot mould which is illustrated in FIG. 11, the plates 23 are attached to mould wall 21 by means of bolts 29 and nuts 210. The bolts 29 are partially embedded in the wall 21, in the position shown in FIG. 11, during the casting step.

In this embodiment of the ingot mould, as in the case of the embodiment illustrated in FIG. 10, plates 23 can be made of an appropriate metallic material, such as steel or cast iron, having a melting point which is not more than 300° C. below the casting temperature of the molten metal in the ingot mould, or of an appropriate non-metallic material such as graphite.

In the embodiment of the mould illustrated in FIG. 11, the outer edge 211 of the upper part of the ingot mould is rounded and the upper surface 212 of the mould is slightly inclined towards the interior of the mould. This provides against the risk of breakage of the inner rim 213, by mechanical shocks, during transportation, storage or use of the ingot mould.

A vent 214 allows the discharge into the atmosphere of any steam pressure that might result, at the time of using the ingot mould, from evaporation of moisture accumulated during storage in the heat insulating material located in the recesses 22. Though only one vent 214 is shown in FIG. 11, it will be clear that any appropriate number of such vents could be used.

Figure 12:
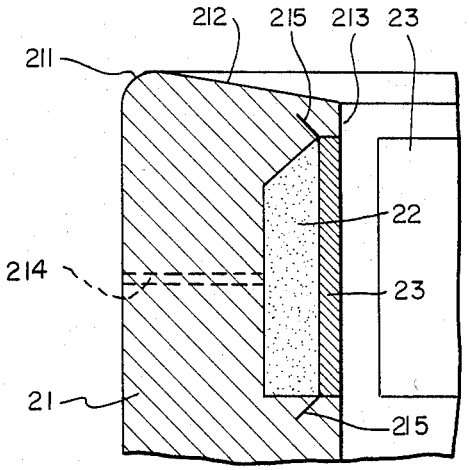
FIG. 12 shows a section of a portion of an ingot mould, according to another embodiment of the mould.

In the embodiment of the mould illustrated in FIG. 12, the securing members for the plates 23 consist of rods 215 which are welded on the top and bottom edges of plates 23 and embedded in the mould. In a modification of this embodiment, similar securing members are additionally or only provided on the lateral edges of plates 23.

Figure 13:
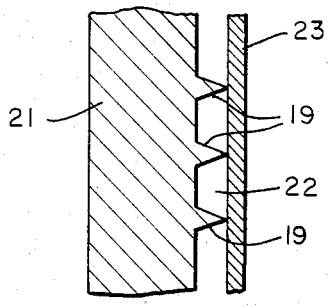
FIG. 13 shows a section of a portion of an ingot mould according to another embodiment.
Figure 14:
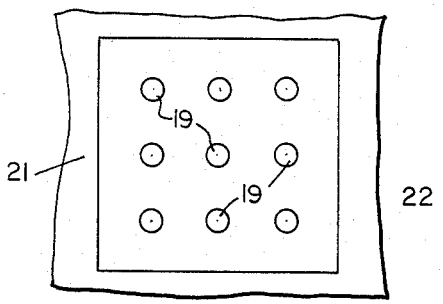
FIG. 14 shows a front view of a portion of the inner surface of the ingot mould of FIG. 13.

In the embodiment of the ingot mould which is illustrated in FIGS. 13 and 14, the outer wall 21 of the mould is provided with cone-shaped protruding parts 19 located inside the recesses 22 and coming into close contact with the inner surfaces of plates 23 (i.e. the surfaces of these plates facing the recesses 22). The function of these protruding parts 19 is to permit bending or deformation of the plates 23 towards the recesses 22 to be limited to the extent which corresponds to the formation of a suitable gap between said plates and the ingot shell.

Figure 15:
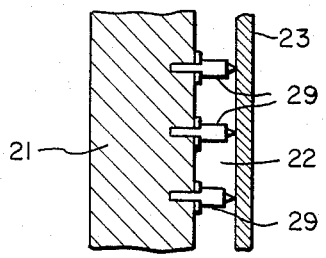
FIG. 15 shows a section similar, to that of FIG. 13, of a portion of an ingot mould according to another embodiment.

In the embodiment of the ingot mould which is illustrated in FIG. 15, pointed members 29 rooted into the outer wall 21 of the mould are provided, instead of the cone-shaped parts 19, their function being identical to that of said parts 19. The members 29 are made of a material, such as steel or cast iron, having a sufficient mechanical resistance.

Figure 16:
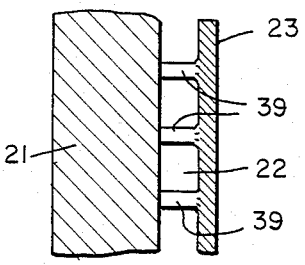
FIG. 16 shows a section, similar to that of FIGS. 13 and 15, of a portion of an ingot mould according to another embodiment.

In the embodiment of the ingot mould which is illustrated in FIG. 16, cylindrical bars 39 (made of a material having a high mechanical resistance such as steel or cast iron) are welded to the inner surface of plate 23 and come into close contact with the bottom face of the recess 22. The axes of these bars 39 are disposed in positions similar to that of the axes of the cone-shaped parts 19 (shown in FIG. 14) and their function is also identical to that of parts 19.

Figure 17:
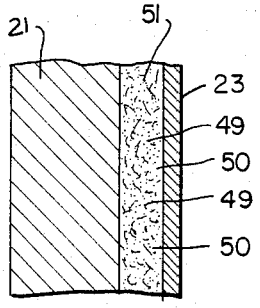
FIG. 17 shows a section, similar to that of FIGS. 13, 15 and 16, of a portion of an ingot mould according to another embodiment.

In the embodiment of the ingot mould which is illustrated in FIG. 17, cone-shaped members 49, made of a material having a sufficient resistance to crushing, such as steel, cast iron, or a hard ceramic material, are placed, in positions similar to that of the parts 19 (shown in FIG. 14), in corresponding housings 50 consisting of holes provided in a mat 51 of compressible insulating fiber material (made of glass fibers or of fibers of ceramic material) located in the recess 22. The function of these cone-shaped members 49 is also similar to that of parts 19, pointed members 29 and bars 39.

It will be clear that other type of separating members could be used with the same function as that of parts 19, members 29, bars 39 and members 49.

It will also be clear that the embodiments illustrated in FIGS. 13 to 17 may be combined together or with any of the embodiments illustrated in FIGS. 1 to 12.

Figure 18:
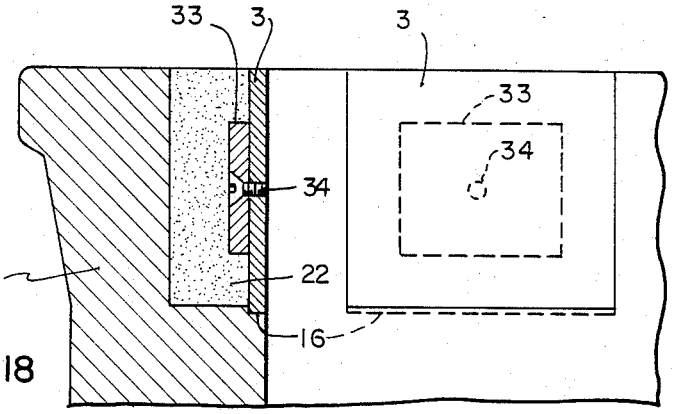
FIG. 18 shows a section of the mould similar to FIG. 2 according to another embodiment of the ingot mould.

In the embodiment illustrated in FIG. 18 a plate 33, having a thickness of the same order as that of plates 3 but having a length and width inferior to those of plates 3, is fixed on the surface of each plate 3 facing the recess 22 by means of a screw 34 placed in the center of plates 3 and 33.

The plates 3 are secured in place by grooves 16 having a semi-circular cross-section, located on the bottom of the recesses 22, for accommodating the bottom edges of plates 3.

In this embodiment, the screws 34 can be replaced by any appropriate fixing means, such as welding joints, each plate 33 being fixed to each plate 3 by fixing means placed in the center of plates 3 and 33.

The plates 3 can be secured in place by any appropriate means such as those which have been described above.

Preferably, the surface area of each plate 33 corresponds to approximately one third of the surface area of the plate 3 to which it is affixed. Plates 33 can be made of the same material as those of plates 3, such as steel or cast iron, but they also may be made of another material.

Owing to the presence of plates 33, bending plates 3 resulting from their thermal expansion under heating upon teeming of the molten metal can only take place towards the recesses 22 which causes the formation of a suitable gap between the wall of plates 3 and the ingot shell.

A further advantage resulting from the presence of plates 33 is that, in an ingot mould of a given capacity, thickness of plates 3 can be reduced thus lowering the amount of heat which is absorbed by plates 3.

In all embodiments of the mould, the plates 23 can be made of any appropriate metallic or non-metallic material such as steel, cast iron or graphite.

EXAMPLE

An ingot mould comprising a hot-top positioned inside the upper part of the mould, according to the embodiment illustrated in FIG. 18 is used for casting an ingot made of a steel suitable for the manufacture of ball-bearings. The ingot mould is made of cast iron, its total capacity is of about 3,000 kg of steel and its total height is of 1,750 mm with a wall thickness of 100 mm and a square section with an inner side dimension of 565 mm at the top and 430 mm at a section distant of 185 mm from the bottom of the mould. The hot-top volume (volume of the interior of the upper part of the mould surrounded by the hot-top inner wall) corresponds to approximately 15% of the total inner volume of the mould.

The inner wall of the hot-top comprises four separate rectangular plates 3 made of low-carbon steel (containing, by weight, 0.12% C.; 0.25% Si and 0.5% Mn) and having a thickness of 12 mm, a length of 500 mm and a width (corresponding to the height of the hot-top) of 275 mm.

Each plate 3 is provided with one low-carbon steel (containing, by weight, 0.12% C.; 0.25% Si and 0.5% Mn) plate 33, having a thickness of 12 mm, a length of 400 mm and a width of 130 mm. The width side of each plate 33 are disposed parallel to the axis of the ingot mould, i.e. vertically when the mould is under its position of use. The plates 3 and 33 are bolted to each other at their center, in the manner illustrated in FIG. 18.

The recesses 22 are filled with ceramic fibers consisting of aluminum silicate having a molar composition of about 50% $Al_{23}O_3$ and 50% $SiO_2$ and an apparent density of 220 kg/m$^3$.

Before each casting operation, a lime slurry is applied like a paint, e.g. by spraying, onto the surface of the plates 3 facing the interior of the mould, thus forming a heat reflective protective coating.

Instead of a lime slurry, aqueous suspensions of magnesite or dolomite and also graphite powder may also be used to form the protective coating.

The hot-top life thus achieved is very high and a high pipe-free volume proportion of the ingot is obtained.

According to another embodiment the inner wall of the hot-top is formed by four steel plates welded together or otherwise fixed to each other at joining edges thereof.

Although, in the above detailed description of the ingot mould according to the invention, reference has been made only to moulds having a square or rectangular section, it will be clear to those skilled in the art that the mould could have other shape of section, such as a oblong oval section, in the recesses and the plates extending, in that case, at least over the parts of great radius of curvature of the upper inner part of the mould, and being separated from each other by the parts of small radius of curvature of the inner wall of the mould itself.

What I claim is:

1. An ingot mould comprising a hot-top positioned inside the upper part of the mould, wherein said hot-top comprises an inner wall formed by a plurality of plates made of a material selected from the group consisting of graphite and metallic materials capable of withstanding contact with a molten metal poured into the ingot mould, without being melted or fused, the thickness of said plates being less than that of the wall of the mould, the plates being capable of expanding at a higher rate than the wall of the mould due to the heat of poured molten metal, a plurality of recesses being provided inside the upper part of the mould, said recesses extending over the parts of relatively large radius of curvature, of the wall of the mould, and being separated from each other by the parts of relatively small radius of curvature of the wall of the mould, and each of said plates being disposed in a corresponding recess, with its inner surface being flush and aligned with the corresponding part of the inner surface of the mould, said plates being laterally maintained in contact with the parts of the mould separating the recesses from each other, the outer surface of each plate being spaced from the confronting surface of the corresponding recess and the thus formed space being at least partially filled with a heat insulating material and wherein a further plate, having a thickness of the same order as that of the plates forming the inner wall of the hot-top and a length and width less than those of said plates, is fixed to the surface of each of said plates facing said recesses, by means of fixing means placed in the center of said further plate and of each plate forming the inner wall of the hot-top.

2. An ingot mould according to claim 1, wherein at least one of the plates forming said inner wall is attached to the mould by securing members which are partially embedded in the mould.

3. An ingot mould according to claim 2, wherein at least one of said securing members consists of a bolt having its head embedded in the wall of the mould while at least a part of its threaded portion projects from the mould wall.

4. An ingot mould according to claim 1, wherein the upper surface of the mould is slightly inclined towards the interior of the mould.

5. An ingot mould according to claim 4, wherein the outer edge of the upper part of the mould is rounded.

6. An ingot mould according to claim 1, wherein at least one vent is provided through the upper part of the mould wall between the interior of at least one of said recesses and at least one aperture located on the outer surface of the mould.

7. An ingot mould according to claim 1, wherein the space between the outer surface of each plate and the confronting surface of its associated recess is filled with a heat insulating material which is deformable under compression.

8. A hot-top and mould combination for receiving a molten metal, comprising:

(a) a plurality of spaced recesses having peripheral edges thereof disposed in said mould at generally one end thereof;

(b) each of said recesses is separated from adjacent ones of said recesses by substantial portions of said mould;

(c) a plate is disposed in each of said recesses and has peripheral edges thereof contiguously engaged with the peripheral edges of said recesses;

(d) each of said plates has an inner surface thereof aligned with an associated inner surface of said mould for therewith providing a molten metal receiving cavity;

(e) said plates are comprised of a material having a coefficient of thermal expansion exceeding the coefficient of thermal expansion of the material of which said mould is comprised;

(f) said plates have a first generally planar position and a second generally concave position whereby filling of said cavity with molten metal causes said plates to become heated and to expand at a rate exceeding the rate of expansion of said mould so that the peripheral edges of said plates bear against the peripheral edges of said recesses of said mould to thereby cause said plates to assume said concave position;

(g) each of said recesses has a rear wall portion spaced from said plates;

(h) a heat insulating material is disposed between said plates and said associated rear wall portions;

(i) a second plate is secured to each of said plates adjacent said rear wall portions; and, (j) said second plate has a length and a width less than the length and width of said plates.

9. The hot-top and mould combination defined in claim 8, wherein:

(a) said plates are comprised of a material selected from the group consisting of graphite and metallic materials having a melting point not more than 300° less than the casting temperature of said molten metal.

10. The hot-top and mould combination as defined in claim 8, wherein:

(a) said mould is generally rectangularly-shaped in cross section;

(b) each of said plates is associated with one of said rectangle sides; and, (c) said rectangle corners are rounded and separate said recesses.

11. The hot-top and mould combination as defined in claim 8, further comprising:

(a) means for positively positioning said plates in said associated recesses.

12. The hot-top and mould combination as defined in claim 11, wherein:

(a) each of said plates include an ear at the lower end thereof; and (b) screw means secure said ears to a bottom portion of the associated recess.

13. The hot-top and mould combination as defined in claim 12, wherein:

(a) each of said plates includes an ear at the upper end thereof;

(b) said plate upper end is aligned with an upper end portion of said mould;

(c) plate means extend between at least said upper end ear and said upper end portion; and (d) pin means secure said plate means to said upper end ear.

14. The hot-top and mould combination as defined in claim 11, wherein:

(a) said recess peripheral edges each includes a groove therein; and (b) said plate peripheral edges each includes a projective portion engagable with said associate groove for thereby positively positioning said plate.

15. The hot-top and mould combination as defined in claim 8, wherein:

(a) at least one of said plates is secured to said mould by securing means at least partially embedded in said mould.

16. The hot-top and mould combination as defined in claim 8, wherein:

(a) said mould has an upper surface; and (b) said recesses have an upper peripheral edge aligned with said mould upper surface.

17. The hot-top and mould combination as defined in claim 16, wherein:

(a) said upper surface is upwardly inclined away from said upper peripheral edge.

18. The hot-top and mould combination as defined in claim 8, wherein:

(a) at least a first vent is disposed in said mould and communicates with at least one of said recesses.

* * * * *